US006435160B2

(12) United States Patent
Round et al.

(10) Patent No.: US 6,435,160 B2
(45) Date of Patent: Aug. 20, 2002

(54) COMPENSATING VOLTAGE CONTROLLER SYSTEM

(75) Inventors: David Christopher Round, Saline; Ross Dykstra Pursifull, Dearborn; Robert James Wilker, Macomb, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/789,232

(22) Filed: Feb. 20, 2001

Related U.S. Application Data

(60) Provisional application No. 60/183,942, filed on Feb. 22, 2000.

(51) Int. Cl.[7] ..... F02D 9/10
(52) U.S. Cl. ..... 123/399; 123/361
(58) Field of Search ..... 123/399, 361

(56) References Cited

U.S. PATENT DOCUMENTS 5,640,943 A * 6/1997 Tasaka et al. ..... 123/399
5,798,624 A * 8/1998 Wilke et al. ..... 123/399
5,992,383 A * 11/1999 Scholten et al. ..... 123/399
6,089,535 A * 7/2000 Mizutani et al. ..... 123/361

* cited by examiner

*Primary Examiner*—Erick Solis
(74) *Attorney, Agent, or Firm*—John E. Kajander

(57) ABSTRACT

An electronic throttle control apparatus includes a variable voltage generator, such as an H-driver, controlling the positioning effort of an electronic throttle motor by generating a variable voltage signal. A current sensing element is coupled to the H-driver and generates a voltage proportional to motor current. A microprocessor is coupled to the H-driver and the current sensing element. The microprocessor determines electronic motor resistance based upon the voltage generated by the H-driver and the current sensing voltage signal. The microprocessor may then modify controller gains based upon the calculated electronic throttle motor resistance.

19 Claims, 2 Drawing Sheets

COMPENSATING VOLTAGE CONTROLLER SYSTEM

RELATED APPLICATIONS

This application claims the benefit of earlier filed provisional patent application Ser. No. 60/183942 filed on Feb. 22, 2000, entitled "Voltage Controller Which Compensates For Resistance Change In Load."

TECHNICAL FIELD

The present invention relates generally to control systems for internal combustion engines, and more particularly, to a compensating voltage controller system.

BACKGROUND ART

Many previously known motor vehicle throttle controls have a direct physical linkage between an accelerator pedal and the throttle body so that the throttle plate is pulled open by the accelerator cable as the driver presses the pedal. The direct mechanical linkage includes biasing that defaults the linkage to a reduced operating position, thus limiting engine output. Nevertheless, such mechanisms are often simple and unable to offer optimal fuel conservation, emissions efficiency, and performance to changing traveling conditions.

An alternative control for improving throttle control and this carefully controlled introduction of fuel air mixture into the engine cylinders is afforded by electronic throttle control.

The electronic throttle control includes a throttle control unit that positions the throttle plate by an actuator controlled by a microprocessor based on the present operating state determined by sensors. A microcontroller is typically included as part of a powertrain electronic control that can adjust the fuel air intake and ignition in response to changing conditions of vehicle operation as well as operator control.

Typical electronic throttle controls control the position of the actuator using either a variable current source or a variable voltage source. Unfortunately, both of these approaches have drawbacks. A current source driving a motor has a less "natural" viscous damping than a voltage source driving a motor. Additionally, converting a voltage source (the vehicle battery) to a current source requires a fast feedback loop on current, which is difficult to implement using H-driver technology.

A voltage source driving an electric motor has different disadvantages. Because motor temperature affects motor resistance, the voltage to torque transfer function changes. This unintended gain change results in a control system where gains have to be reduced to accommodate the motor resistance variability. Other considerations, such as, stability, overshoot, and position, limit any possible gain reduction. One possible remedy would be to modify the controller using feedback from temperature sensor. Unfortunately, this adds additional cost and complexity to the system.

The disadvantages associated with these conventional electronic throttle control techniques have made it apparent that a new technique for electronic throttle control is needed. The new technique should provide "natural" viscous damping (associated with voltage control) while compensating for motor temperature changes (associated with current control). Additionally, the new technique should negligibly increase overall system cost and complexity. The present invention is directed to these ends.

SUMMARY OF THE INVENTION

It is, therefore, an object of the invention to provide an improved and reliable compensating voltage controller system. Another object of the invention is to provide "natural" viscous motor damping while compensating for motor temperature changes. An additional object of the invention is to maintain current overall system cost and complexity.

In accordance with the objects of this invention, a compensating voltage controller system is provided. In one embodiment of the invention, an electronic throttle control apparatus includes a variable voltage source, such as an H-driver modulating battery voltage, controlling the position of a throttle motor by generating a variable voltage signal. A current sensing element is coupled to the H-driver and generates a voltage proportional to the current passing through both the H-driver and motor. A microprocessor is coupled to the H-driver and the current sensing element. The microprocessor determines electronic motor resistance based upon the voltage applied by the H-driver and the current sensing voltage signal. The microprocessor may then modify applied motor voltage based upon the calculated electronic throttle motor resistance.

The present invention thus achieves an improved compensating voltage controller system. The present invention is advantageous in that it allows the use of an H-driver voltage source while achieving the advantages of a current source.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
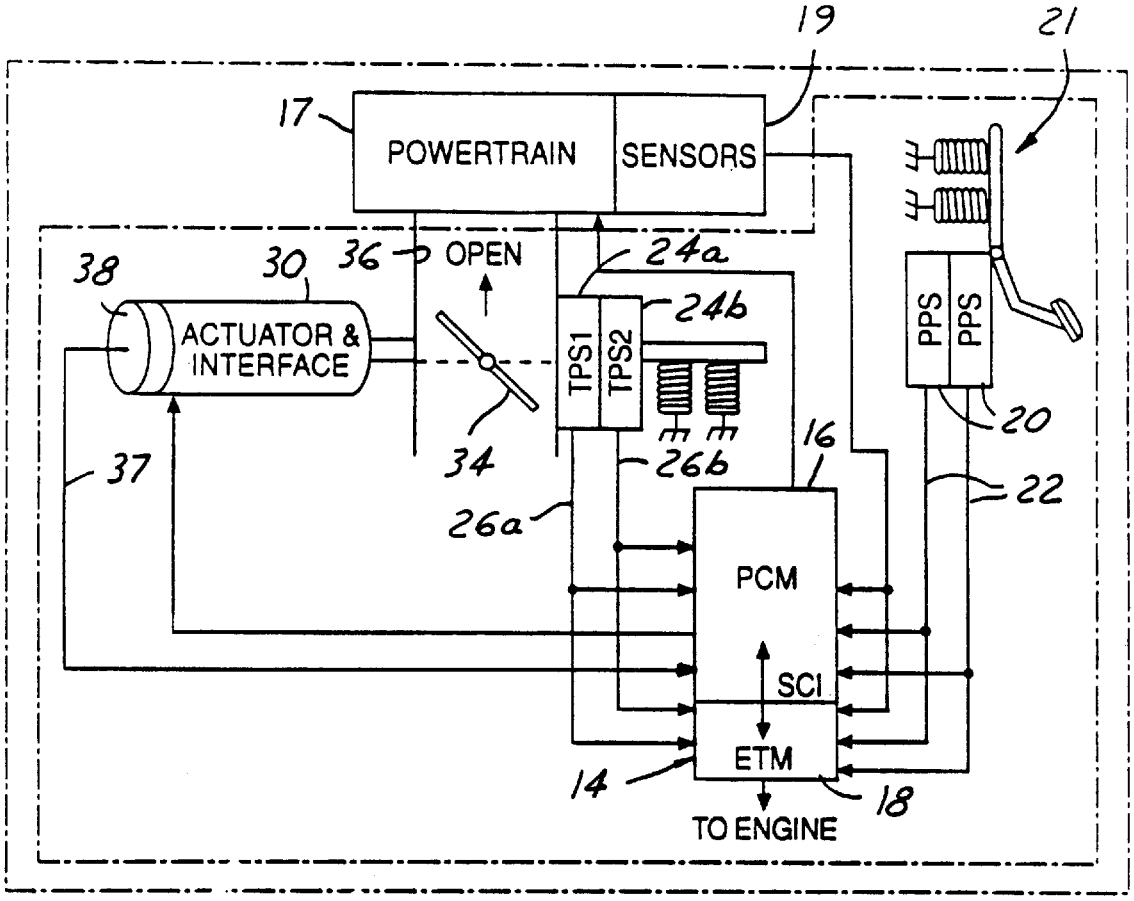
FIG. 1 is a block diagram of an electronic throttle system having a compensating voltage controller system in accordance with one embodiment of the present invention.

In the following figures, the same reference numerals will be used to identify identical components in the various views. The present invention is illustrated with respect to an compensating voltage controller system, particularly suited for the automotive field. However, the present invention is applicable to various other uses that may require compensating voltage controller systems.

Referring to FIG. 1, a motor vehicle powertrain system 10 including compensating voltage controller system 12 includes an electronic control unit 14. In the preferred embodiment, the electronic control unit 14 includes a powertrain control module (PCM) 16 including a main processor and an electronic throttle control (ETC) 18 including an independent processor. The PCM and ETC share sensors 19 and actuators that are associated with the powertrain system 17 and control module 16. Preferably, the electronic throttle control (ETC) 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19, 26 for independent processing.

A wide variety of inputs are represented in the FIG. 1 diagram by the diagrammatic representation of two or more redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain an actual throttle position indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of outputs to an actuator and motive interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the powertrain control module 16, as shown at 37, 26*a* and 26*b*, respectively, to determine whether alternative responses are required or to maintain information for service or repair.

Unfortunately, temperature changes in the drive motors 30 cause unintended and uncompensated controller gain changes. In the prior art, this requires a general lowering of gains and thus lowering of position performance. The present invention addresses this problem by sensing motor current, calculating motor resistance, and using motor resistance to compensate the controller gains. This results in increased positioning performance.

Figure 2:
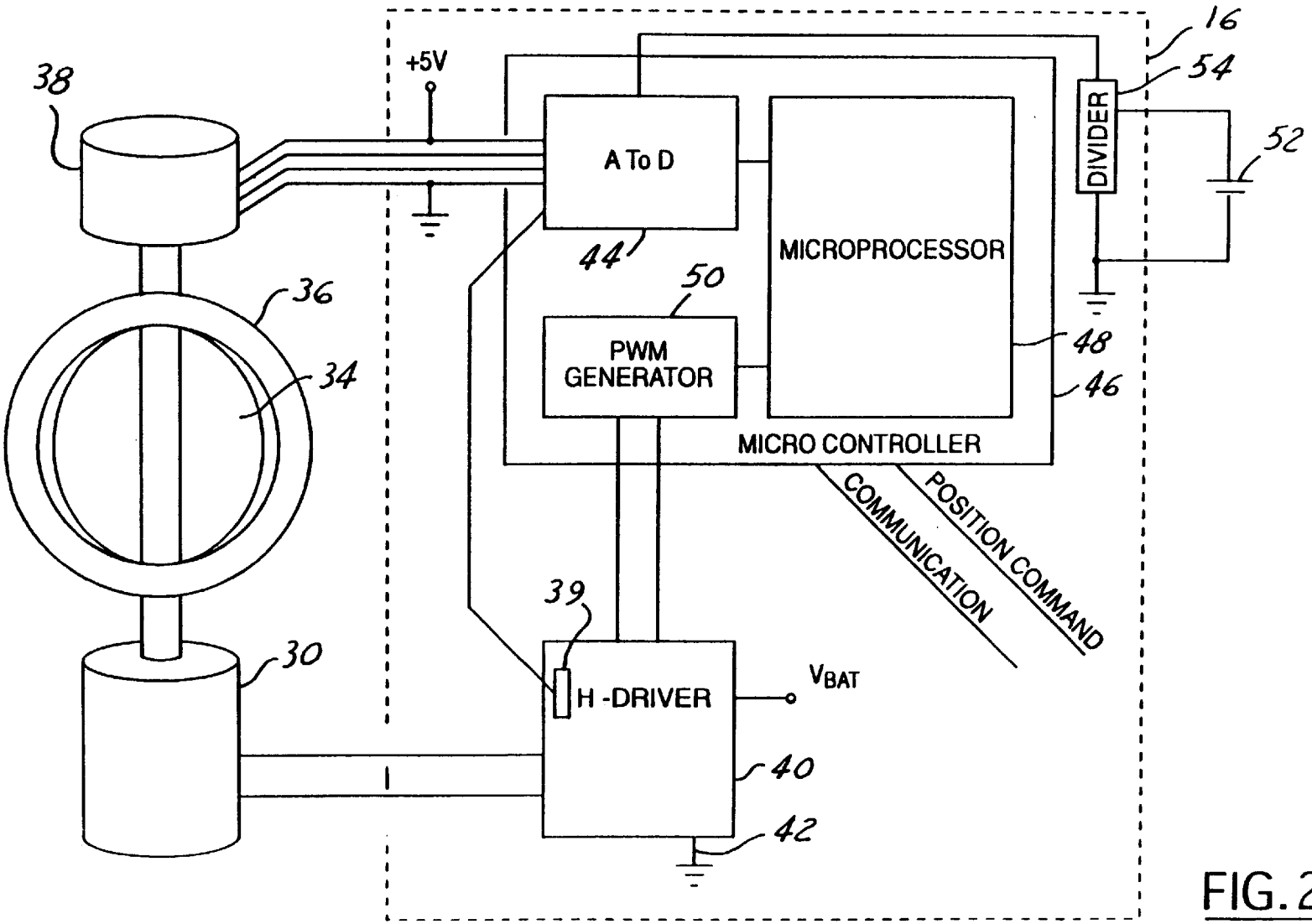
FIG. 2 is a block diagram of a compensating voltage controller system in accordance with one embodiment of the present invention.

Referring to FIG. 2, a block diagram of a compensating voltage controller system in accordance with one embodiment of the present invention is illustrated. In the present invention, by realizing that motor temperature, and thus motor resistance, change slowly, it is possible to implement a current feedback system that operates at a very low bandwidth. By operating at a bandwidth that is much lower that the derivative control's requisite bandwidth, the invented system retains all the desirable "natural" viscous damping associated with a pure voltage control system (powered from vehicle battery 52), but also has all the desirable torque gain insensitivity associated with a pure current control system.

One necessary component in the present invention is a current sensing element 38. One skilled in the art would realize that a current sensing element 39 might take many forms. In the present invention, actuator 30 is driven using an integrated circuit H-driver 40. This means that current may be measured by placing a current sense resistor in the ground leg 42. While this method works somewhat, the chip's internal current mirror may be utilized to output a voltage that represents current, which is a superior approach. The voltage output that represents current is then fed into an A/D 44 of the Throttle Plate Position Controller (TPPC) microcontroller 46. Motor current has huge swings at the period of the H-driver duty cycle and the voltage representing current needs to be analog filtered before being read by the microcontroller's A to D to prevent aliasing.

Microprocessor 48 of the TPPC 46 knows the duty cycle and direction that it is commanding to the motor's H-driver 40 (communicated via so-called "magnitude" and "direction" lines) using a PWM generator 50. Further, the TPPC 46 senses the voltage of the voltage source 39 in relation to the voltage supplied by divider 54. Using these two pieces of information the TPPC 46 knows the instantaneous voltage applied to the motor 30.

In the present invention, when the TPPC 30 determines the instantaneous motor current and instantaneous motor voltage, the quotient of voltage divided by current determines the motor resistance (in the case where the throttle motion is nearly still). Should the motor be in motion, the present invention would have to account for its back EMF.

As stated before, the motor temperature and thus resistance is changing slowly. Thus, the present invention may apply a simple resistance detection technique to determine the motor resistance. One possible implementation is to wait until the actuator position is constant within a band and then average (i.e., filter) the instantaneous values of applied voltage and sensed current. Motor resistance is then calculated as the quotient of voltage divided by current.

The present invention then uses this resistance data to normalize controller 46 gains. To get constant positioning performance over temperature the present invention normalizes the gains by multiplying the controller gain by the ratio of measured resistance divided by nominal resistance. Effectively, this maintains constant gains in terms of current, and thus constant torque gain to the controlled device. The controlled system is benefited by constant torque gain.

Not only does the present invention provide a measure of resistance, but also a measure of temperature. With this measure of temperature the present invention can: 1) Detect motor overheat conditions and advise the Powertrain Control Module (PCM) 16. 2) Modify control terms which have a sensitivity to temperature (examples include a friction fighter term which is a proportional term based on sign of error; and the damping term which is based on the derivative of position error or the derivative of position).

The present invention thus achieves an improved and reliable compensating voltage controller system by monitoring the current output of a variable voltage source controller. In this way, the present invention provides "natural" viscous motor damping while compensating for motor temperature changes. Additionally the present invention nearly maintains current overall system cost and complexity.

From the foregoing, it can be seen that there has been brought to the art a new and improved compensating voltage controller system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims.

What is claimed is:

1. An electronic throttle control apparatus comprising:

a variable voltage generator coupled to and controlling positioning effort of an electronic throttle actuator by generating a variable voltage signal;

a current sensing element coupled to said variable voltage generator and detecting motor current, said current sensing element generating a current sensing voltage signal proportional to said current; and a microprocessor coupled to said variable voltage generator and said current sensing element, said microprocessor including control logic operative to command said variable voltage generator to change said position of said electronic throttle actuator, determine electronic throttle actuator resistance based upon said variable voltage signal and said current sensing voltage signal, and normalize said position based upon said electronic throttle actuator resistance.

2. The apparatus as recited in claim 1, further comprising an analog-to-digital converter coupled to said current sensing element and said microprocessor, said analog-to-digital converter converting said current sensing voltage signal to a digital signal.

3. The apparatus as recited in claim 2, further comprising pulse width modulation generator coupled to said variable voltage generator and said microcontroller, said pulse width modulation generating a pulse width modulation signal having an applied duty cycle for said variable voltage generator based upon microcontroller commands.

4. The apparatus as recited in claim 3, wherein variable voltage generator is an H-driver integrated circuit.

5. The apparatus as recited in claim 4, wherein said current sensing element is a current mirror located in said H-driver integrated circuit.

6. The apparatus as recited in claim 5, wherein said microprocessor further includes control logic operative to determine instantaneous motor current based upon the quotient of said predetermined duty cycle and said current sensing voltage signal.

7. The apparatus as recited in claim 6, wherein said microprocessor further includes control logic operative to wait until said electronic throttle actuator is approximately motionless before determining electronic throttle actuator resistance.

8. The apparatus as recited in claim 7, wherein said microprocessor further includes control logic operative to determine electronic throttle actuator resistance when said electronic throttle actuator is moving based upon actuator back EMF.

9. The apparatus as recited in claim 8, wherein said microprocessor further includes control logic operative normalize gains by multiplying said gains by the ratio of electronic throttle actuator resistance divided by a predetermined nominal actuator resistance.

10. The apparatus as recited in claim 9, electronic throttle actuator resistance is a motor.

11. A method for controlling a positioning device of an internal combustion engine, the method comprising the steps of:

providing an electric motor for actuating said positioning device to a given position;

commanding an variable voltage generator to control said electric motor by generating a variable voltage signal;

detecting a current of said variable voltage signal using a current sensing element;

determining electric motor resistance based upon a quotient of said variable voltage signal divided by said current; and normalizing said given position based upon said electric motor resistance.

12. The method as recited in claim 11, further comprising the step of generating a current sensing voltage signal proportional to said current and converting said current sensing voltage signal to a digital signal.

13. The method as recited in claim 12, further comprising the step of generating a pulse width modulation signal having a predetermined duty cycle for said variable voltage generator.

14. The method as recited in claim 13, wherein variable voltage generator is an H-driver integrated circuit.

15. The method as recited in claim 14, wherein said current sensing element is a current mirror located in said H-driver integrated circuit.

16. The method as recited in claim 15, further comprising the step of determining instantaneous motor current based upon the quotient of said applied duty cycle and said current sensing voltage signal.

17. The method as recited in claim 16, further comprising the step of waiting until said electric motor is approximately motionless before determining electric motor resistance.

18. The method as recited in claim 17, further comprising the step of determining electric motor resistance when said electric motor is moving based upon electric motor back EMF.

19. The method as recited in claim 18, further comprising the step of normalizing gains by multiplying said gains by the ratio of electric motor resistance divided by a predetermined nominal electric motor resistance.

* * * * *